US005832934A

United States Patent [19]

Schmidt

[11] Patent Number: 5,832,934

[45] Date of Patent: Nov. 10, 1998

[54] HAND HELD PORTABLE CIGAR HUMIDOR

[75] Inventor: G. Gerry Schmidt, Newport Beach, Calif.

[73] Assignee: Pacific Handy Cutter, Costa Mesa, Calif.

[21] Appl. No.: 746,016

[22] Filed: Nov. 5, 1996

[51] Int. Cl.[6] ..... A24F 13/00

[52] U.S. Cl. ..... 131/329; 131/300; 206/270

[58] Field of Search ..... 131/329, 300, 131/302, 303, 248, 251, 249; 401/52, 195, 202; 206/270

[56] References Cited

U.S. PATENT DOCUMENTS

| | | | |
|---|---|---|---|
| D. 23,579 | 8/1894 | Walters . | |
| D. 147,120 | 5/1947 | Dietrich . | |
| 317,980 | 5/1885 | Dixon | 131/251 |
| 827,558 | 7/1906 | Niell . | |
| 1,021,849 | 4/1912 | Schwieger . | |
| 1,143,463 | 6/1915 | Terwilliger, Jr. . | |
| 1,237,023 | 8/1917 | Davidson . | |
| 1,450,674 | 4/1923 | Marston . | |
| 1,509,311 | 9/1924 | Perry . | |
| 1,770,920 | 7/1930 | Hermani . | |
| 1,908,890 | 5/1933 | Burns | 131/248 |
| 1,999,554 | 4/1935 | Zucker | 131/300 |
| 2,010,440 | 8/1935 | Ryan . | |
| 2,365,185 | 12/1944 | Gailey . | |
| 2,862,779 | 12/1958 | Hammond . | |
| 4,997,082 | 3/1991 | Durocher . | |
| 5,011,009 | 4/1991 | Scheurer . | |

*Primary Examiner*—Vincent Millin
*Assistant Examiner*—Charles W. Anderson
*Attorney, Agent, or Firm*—Oppenheimer Poms Smith

[57] ABSTRACT

A hand held portable humidor for cigars including a humidifying material for maintaining a substantially constant relative humidity within the humidor, the humidor including an upper housing and a lower housing which is formed of a material less rigid than the upper housing, with the lower housing being telescopically fitted within the upper housing such that a sliding seal is maintained between the upper housing and the lower housing. The upper housing includes an inwardly directed ridge; and the lower housing includes an outwardly directed ridge which contacts the inward directed ridge of the upper housing when the humidor is in a fully extended configuration preventing the lower housing from separating from the upper housing. The upper housing includes an exterior surface to which a cigar cutter is detachably secured. The humidor also includes a lid secured to the upper housing and an enclosure sized to receive the humidifying material. The enclosure includes at least one porous surface and a tab portion positioned against the lid to retain the enclosure within the lid and to provide a structure which facilitates easy removal of the enclosure from the lid.

20 Claims, 4 Drawing Sheets

Fig. 11.
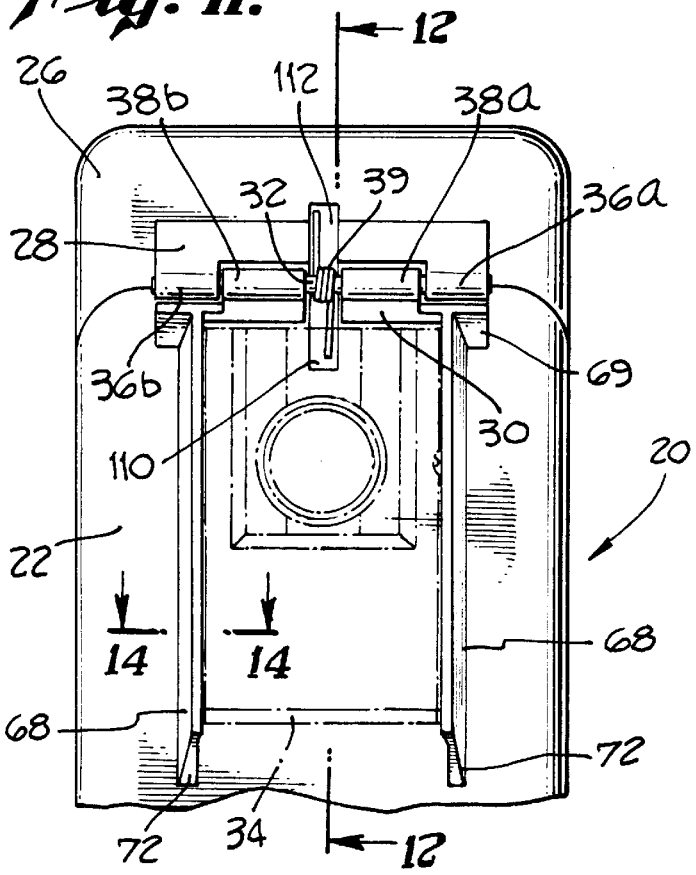
Fig. 12.
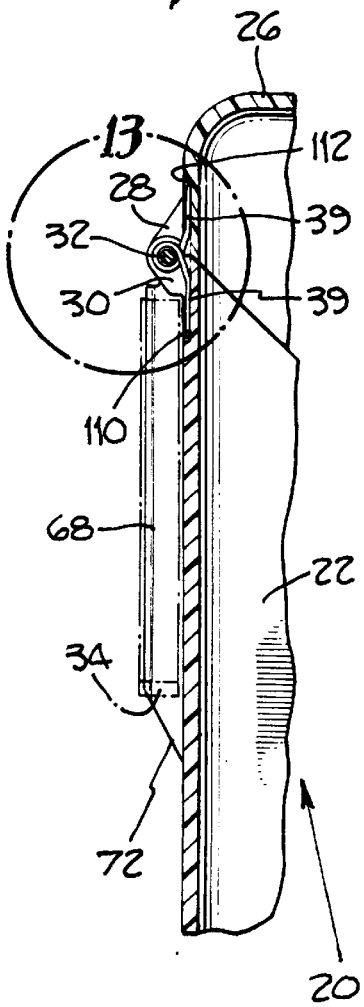
Fig. 13.
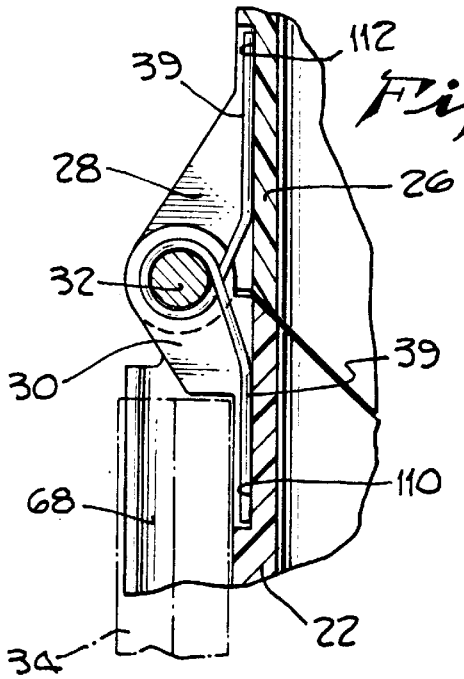
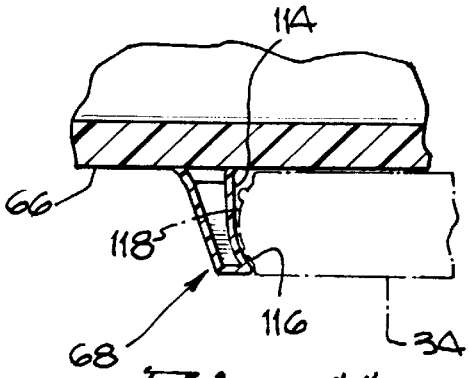
Fig. 14.

HAND HELD PORTABLE CIGAR HUMIDOR

BACKGROUND OF THE INVENTION

1. Field of the Invention

The present invention relates to a hand held portable cigar humidor and, more particularly, pertains to a humidor including upper and lower housing portions telescopically interfitted such that a sliding seal is maintained between the housing portions.

2. Description of the Related Art

Cigar aficionados have long known that some of the best cigars in the world are grown in tropical or equatorial areas and that such cigars are optimally aged in an environment where the relative humidity is high (approximately 70% ). Accordingly, various humidifying devices and humidors have been employed in an attempt to replicate the humid climate where the cigar tobacco was grown. Known humidors include rooms and various boxes including humidifiers within which cigars are stored and aged. However, prior art humidors fail to address the need for a portable humidor within which cigars of various sizes may be safely transported without being damaged.

In order to optimize the smoking experience, cigar smokers additionally rely upon other equipment and tools, such as a cutter for properly removing the tip of a cigar. Significantly, the prior art is devoid of a hand held portable humidor including a detachable cigar cutter. The present invention accommodates the need to safely transport cigars varying in size and further embodies a convenient and integrated assembly including a key article of cigar smoking paraphernalia.

SUMMARY OF THE INVENTION

In accordance with a specific illustrative embodiment of the present invention, a hand held portable humidor with a humidifying material for maintaining a substantially constant relative humidity within the humidor includes an upper housing including a lid sized to receive the humidifying material and a lower housing formed of a material less rigid than the upper housing. The lower housing is telescopically fitted within the upper housing such that a sliding seal is maintained between the upper housing and the lower housing.

In a further aspect of the present invention, the hand held portable humidor includes a housing and a lid pivotally secured to the housing and sized to receive the humidifying material. The housing includes an exterior surface; and the hand held portable humidor additionally includes a cigar cutter and means formed on the exterior surface for detachably securing the cigar cutter to the housing.

In still another aspect of the present invention, the hand held portable humidor includes: an upper housing including an exterior surface and an inwardly directed ridge; a lid pivotally secured to the upper housing; an enclosure sized to receive a humidifying material, the enclosure including at least one porous surface and a tab portion positioned against the lid to retain the enclosure within the lid and to provide a means for removing the enclosure from the lid; a lower housing formed of a material less rigid than the upper housing, the lower housing being telescopically fitted within the upper housing such that a sliding seal is maintained between the upper housing and the lower housing, the lower housing including an interior surface defining slots for receiving at least one partition, the lower housing including an outwardly directed ridge which contacts the inwardly directed ridge of the upper housing when the humidor is in a fully extended configuration preventing the lower housing from separating from the upper housing; a cigar cutter; and means formed on the exterior surface for detachably securing the cigar cutter to the upper housing.

DESCRIPTION OF THE DRAWINGS

Other objects, features and advantages of the invention will become readily apparent upon reference to the following detailed description when considered in conjunction with the accompanying drawings, in which like reference numerals designate like parts throughout the figures thereof, and wherein:

FIG. 11 is an enlarged view of the upper housing and lid portions of the cigar humidor shown in FIG. 5;

FIG. 12 is a cross-sectional side view of the cigar humidor taken along the plane 12—12 of FIG. 11;

FIG. 13 is an enlarged side view of the cigar humidor's hinge mechanism at circle 13 of FIG. 12; and FIG. 14 is a cross-sectional view of the cigar humidor and its attached cigar cutter taken along the plane 14—14 of FIG. 11.

DETAILED DESCRIPTION OF THE PREFERRED EMBODIMENTS

Figure 1:
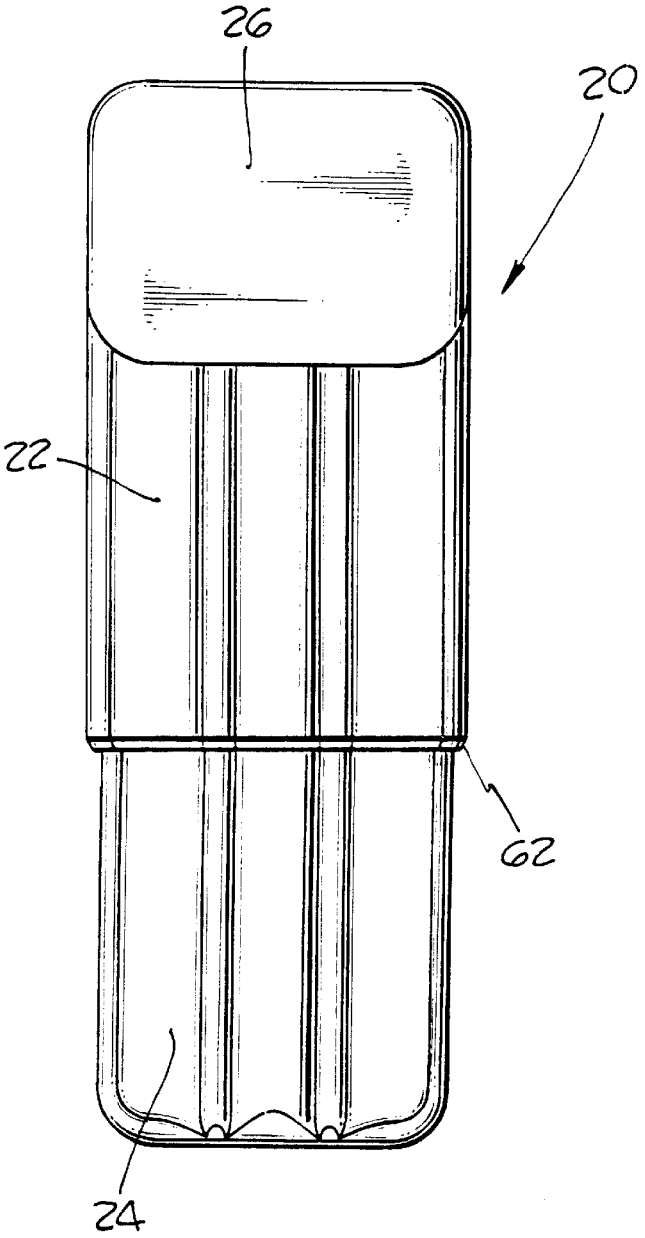
FIG. 1 is a front view of a preferred exemplary embodiment of hand held, portable cigar humidor of the present invention.
Figure 2:
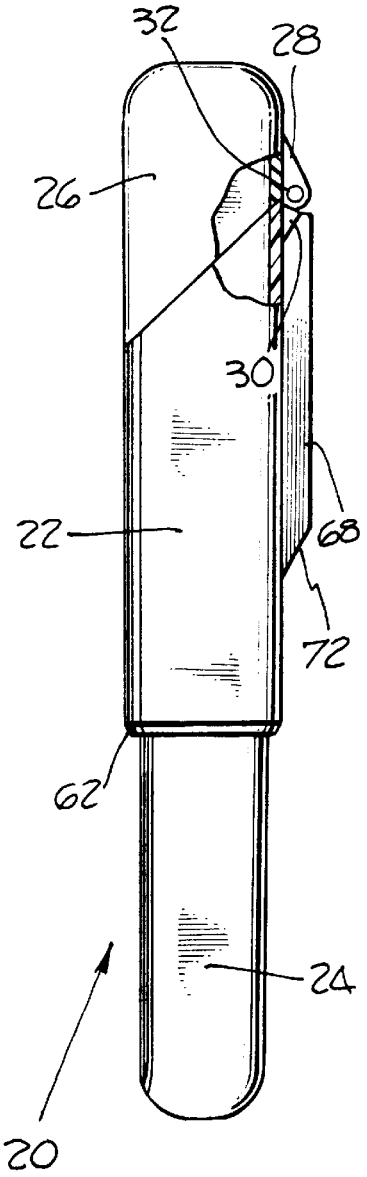
FIG. 2 is a partial cross-sectional side view of the cigar humidor shown in FIG. 1.

Referring initially to FIGS. 1 and 2, a preferred exemplary embodiment of the hand held, portable cigar humidor 20 of the present invention is illustrated in front and side views respectively. The cigar humidor 20 includes an upper housing 22 and a lower housing 24 which is telescopically fitted within the upper housing 22. The cigar humidor 20 also includes a lid 26 which is preferably, but not necessarily, pivotally secured to the upper housing 22.

A key aspect of the present invention is that the upper housing 22 and the lower housing 24 are formed in such a manner that a "sliding seal" is maintained between the upper housing 22 and the lower housing 24. A substantially hermetic seal is maintained between the upper housing 22 and the lower housing 24 by forming the upper housing 22 and the lower housing 24 from different materials as discussed below and by sizing the lower housing 24 to have an outer diameter which is greater than the inner diameter of the upper housing 22.

Generally, the lower housing 24 is formed of a material which is less rigid than the upper housing 22. The upper housing 22 is preferably formed from an ABS (Acrylonitrile-butadiene-styrene) plastic or a similarly rigid and durable material. The lower housing 24 is preferably formed from a material such as Delrin which is sufficiently olefinic or otherwise lubricative. Preferably, the outer diameter of the lower housing 24 is approximately one mil larger than the inner diameter of the upper housing 22. Thus, through proper relative sizing of the upper housing 22 and the lower housing 24 and by selecting the respective materials from which they are formed as discussed above, a sliding seal is formed when the lower housing 24 is telescopically fitted within the upper housing 22. As a result, the humidor 20 is adjustable in length to accommodate cigars of varying lengths while retaining its substantially hermetic character.

As best seen in the partial cross-sectional side view of FIG. 2, the cigar humidor 20 illustrated includes an exemplary means for pivotally connecting or securing the lid 26 to the upper housing 22. Such a securing means includes a first hinge member 28 mounted to the lid 26, a second hinge member 30 mounted to the upper housing 22, and a pin 32.

As is also shown in FIG. 2, the upper housing 22 and lid 26 are preferably formed with complementary edges such that the upper housing 22 and the lid 26 fit together flush. When the lid 26 is in a closed position, the complementary edges should be aligned with no indentations resulting in a substantially hermetic seal being formed between the upper housing 22 and the lid 26. Additionally, the complementary edges are preferably contoured as shown (diagonally) so that the lid can be opened without damaging the cigars inside the humidor 20 and to facilitate easier access to the cigars.

Figure 3:
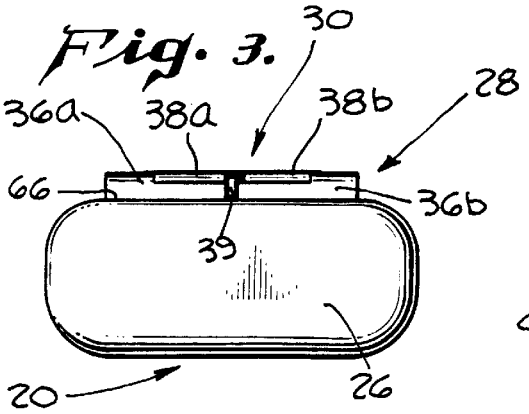
FIG. 3 is a top view of the cigar humidor shown in FIG. 1.

Referring now to FIG. 3, which is a top view of the cigar humidor 20, the first hinge member 28 includes two outer sleeve portions 36*a*, 36*b*. The second hinge member 30 includes two inner sleeve portions 38*a* and 38*b*. The two outer sleeve portions 36*a*, 36*b* abut opposing ends of the inner sleeve portions 38*a*, 38*b* when the lid 26 is assembled to the upper housing 22 by installing the pin 32 through portions 36*a*, 36*b*, 38*a*, and 38*b*. As discussed in greater detail with reference to other figures, the means for pivotally connecting or securing the lid 26 to the upper housing 22 also includes a spring member 39 which exerts a force on the lid 26 tending to force the respective complementary edges of the upper housing 22 and the lid 26 together. It should be understood that the lid 26 may be secured to the upper housing 22 by other mechanical means. For example, the lid 26 and the upper housing 22 may be formed such that the two "snap fit" together. By way of further example, the upper housing 22 and lid 26 may be cylindrically shaped such that threads or the like may be employed to facilitate a "twist on" means of securing the lid 26 to the upper housing 22.

Figure 4:
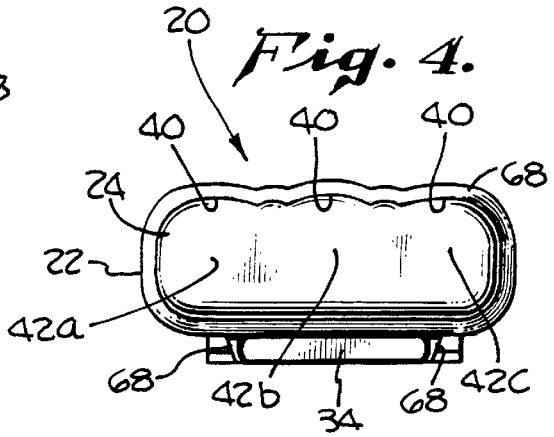
FIG. 4 is a top view of the cigar humidor shown in FIG. 3 with the pivoted lid removed.

As best shown in FIG. 4, the upper housing 22 is contoured to receive a plurality of cigars. A contoured inner surface 40 of the upper housing 22 defines a plurality of cylindrical portions 42*a*, 42*b*, 42*c* of the humidor 20. Preferably, a single, properly sized cigar is stored within each of the cylindrical portions 42*a*, 42*b*, 42*c*. A cigar which is too narrow in gauge may contact or collide with the inner surface 40 resulting in damage to the outer leaf of the cigar. It should also be appreciated that the humidor 20 may be designed to store a smaller or larger number of cigars than three. Furthermore, the arrangement of the cylindrical portions 42 is not necessarily linear.

Figure 5:
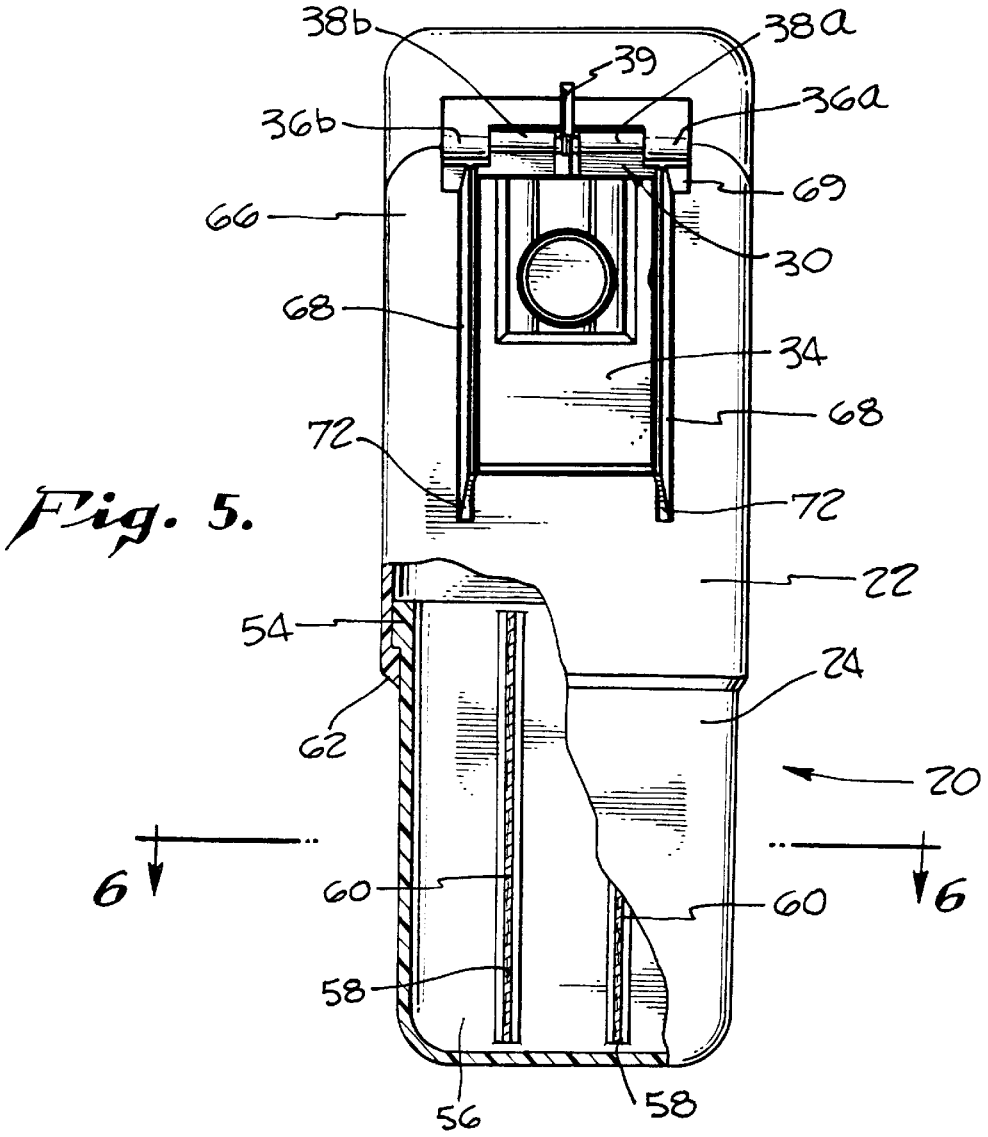
FIG. 5 is a partial cross-sectional rear view of the preferred embodiment of the hand held, portable cigar humidor of the present invention.

The humidor 20 is shown in FIGS. 1, 2 and 5 in a fully extended configuration. As shown in FIG. 5, the lower housing 24 includes an interior surface 56 defining slots 58 for receiving partition members 60. The upper housing 22 includes an inwardly directed ridge 62 circumferentially formed therearound at the end of the upper housing 22 which is fitted over the lower housing 24. The lower housing 24 includes an outwardly directed ridge 64 circumferentially formed therearound at the end of the lower housing which is fitted into the upper housing 22. When the humidor 20 is in the fully extended configuration, the outwardly directed ridge 64 makes contact or collides with the inwardly directed ridge 62 thereby preventing the lower housing 24 from separating from the upper housing 22. Thus, the upper housing 22 and the lower housing 24 of the humidor 20 are constructed and assembled such that a substantially hermetic sliding seal is maintained between the upper housing 22 and the lower housing 24.

The upper housing 22 also includes an exterior surface 66 which is preferably, but not necessarily, substantially planar.

The cigar humidor 20 also includes a cigar cutter 34 and means for detachably securing the cigar cutter 34 to the upper housing 22. The aforementioned securing means preferably comprises a plurality of ridges 68 formed on the exterior surface 66. Each ridge 68 includes a surface 72 which tapers toward the exterior surface 66 providing greater structural stability to the ridges 68 and eliminating a sharp edge which would otherwise be presented by the ridges 68.

As shown in FIG. 5, the plurality of ridges 68 are configured and positioned on the exterior surface 66 to provide a means for detachably securing the cigar cutter 34 to the upper housing 22. Generally, the means for detachably securing may be described as a "friction fit". More specifically, the ridges 68 are formed as rail members which are curved inwardly toward each other for receiving the cigar cutter 34 therebetween. Preferably, the ridges 68 are also formed on the exterior surface 66 to converge slightly from the bottom end of the upper housing 22 toward the lid 26 thereby effecting the aforementioned friction fit of the cigar cutter 34 between the ridges 68. The cigar cutter 34 shown in FIG. 5 is formed to include a surface complementary to the inner facing sides of the plurality of ridges 68. In this preferred embodiment, the cigar humidor 20 also includes a top ridge 69 positioned to support the hinge means for pivotally securing the lid 26 to the upper housing 22 or, more specifically, the second hinge member 30.

Figure 6:
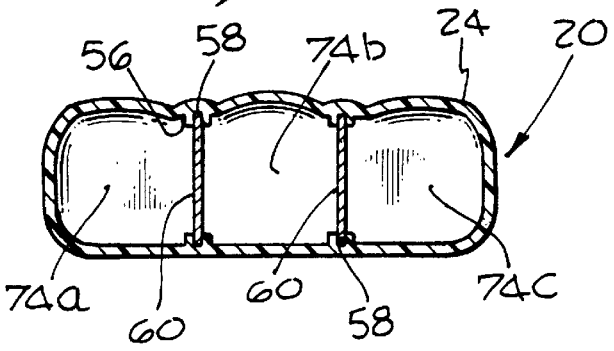
FIG. 6 is a cross-sectional view of the exemplary cigar humidor taken along the plane 6—6 in FIG. 5.

Referring now to FIG. 6 which is a cross-sectional view of the lower housing 24 taken along its plane 6—6 of FIG. 5, which best illustrates how the partitions 60 are fitted into the lower housing 24. The interior surface 56 is preferably contoured as shown defining the slots 58 within which the partitions 60 are fitted. The partitions 60 preferably comprise strips of Spanish cedar wood which impart a desirable aromatic quality and flavor to cigars stored within the humidor 20. In this embodiment, the boundaries of cylindrical portions 74*a*, 74*b*, 74*c* are defined by the interior surface 56 and the partitions 60. It should be understood that the interior surface 56 may by contoured differently than shown in FIG. 6. Furthermore, the number and geometric arrangement of the cylindrical portions 74 can be varied.

Figure 7:
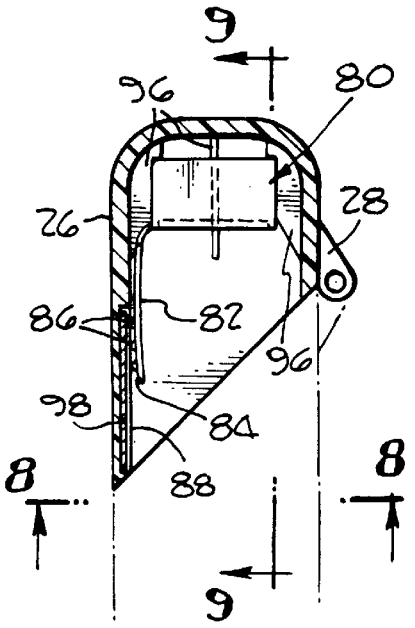
FIG. 7 is a cross-sectional side view of a pivotally mounted lid of the exemplary cigar humidor shown in FIGS. 1 through 6.

The pivotally mounted lid 26 of the cigar humidor 20 is best seen in the cross-sectional side view of FIG. 7. An enclosure 80 sized to receive a humidifying material is fitted within the lid 26. The enclosure 80 includes a tab portion 82 which is positioned against the lid 26 to retain the enclosure 80 within the lid 26 and to provide a means for easily removing the enclosure 80 from the lid 26. In the illustrated preferred embodiment, the tab portion 82 is slightly curved, formed from a semi-rigid plastic, and includes an outside face 84 upon which a plurality of bumps 86 are formed. The bumps 86 being molded integrally of the tab portion 82 cause it to have a curved shape to facilitate a user grasping the free end of the tab portion 82. The bumps 86 also serve to create a gap between the tab portion 82 and an interior surface 88 of the lid 26 and, for example, may be formed in a hemispherical or other conveniently manufactured shape. The aforementioned gap keeps the tab portion 82 from laying flush against the interior surface 88 thereby making the tab portion 82 easier to grasp with the fingers.

Figure 8:
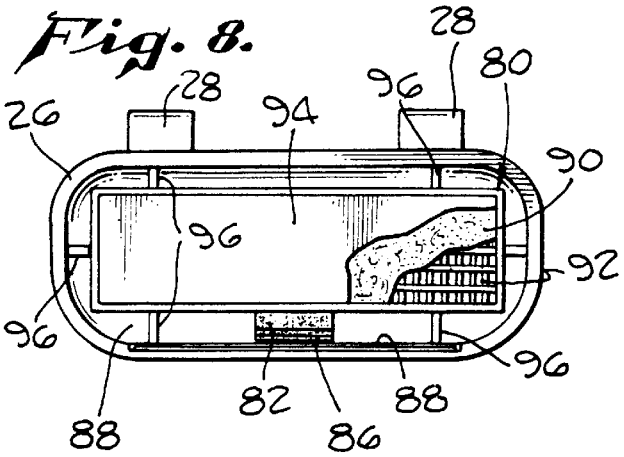
FIG. 8 is a partial cross-sectional bottom view of the pivotally mounted lid taken along the plane 8—8 of FIG. 7.

As best seen in FIG. 8, which is a partial cross-sectional bottom view of the pivotally mounted lid 26 taken along the plane 8—8 of FIG. 7, a humidifying material 90 is fitted within the enclosure 80 provided in the lid 26. The humidifying material 90 may comprise a sponge-like material impregnated with a mixture of water and tensio-active substances which limit the potential of the evaporation of the water. The humidifying material 90 maintains a substantially constant relative humidity of the air within the humidor 20 and is available, for example, from Credo located at 34, rue Roussel Dorla, 13004 Marseille, France. The relative humidity of the air within the humidor 20 is a function of the composition of the aforementioned mixture. An exemplary impregnating solution comprises 4.15% of glycerol (glycerine) and 95.85% pure water.

The enclosure 80 additionally includes at least one porous surface 92 and an enclosure lid 94 as shown in FIG. 8. The sponge-like material 90 should be sized to fit properly within the enclosure 80 and, particularly, to accommodate any expansion of the material 90 after it is impregnated with the water/tensio-active substances mixture. The sponge-like material 90 is available, for example, from Smithers-Oasis U.S.A, P.O. Box 118, Kent, Ohio 44240, U.S.A.

The humidor 20 also includes means formed within the lid 26 for securing the enclosure 80 within the lid 26. The securing means may comprise, for example, a plurality of fins 96 formed within the lid 26 on the interior surface 88. The enclosure 80 should be sized to fit snugly within the securing means formed by the plurality of fins 96.

Figure 9:
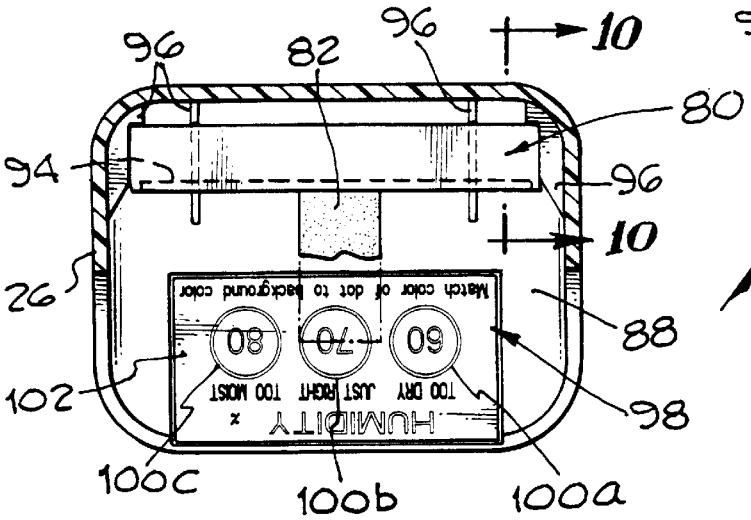
FIG. 9 is a cross-sectional rear view of the pivotally mounted lid taken along the plane 9—9 of FIG. 7.

As best seen in FIG. 9, which is a cross-sectional rear view of the pivotally mounted lid 26 taken along the plane 9—9 of FIG. 7, the preferred humidor 20 additionally includes an indicator 98 for providing an indication of the relative humidity within the humidor 20. The relative humidity indicator 98 can be attached to the interior surface 88 or formed therein as best shown in FIG. 7.

The indicator 98 shown in FIG. 9 preferably includes at least three indicator regions 100 which each change color at a different relative humidity, for example: region 100*a* , 60%; region 100*b* , 70%; and region 100*c*, 80%. The indicator 98 also includes a background region 102. The region 100 closest in color to the color of the background region 102 indicates the relative humidity of the air inside the humidor 20. The relative humidity is ideal when the color of region 100*b* is the same as the color of the background region 102. The relative humidity is too low when the color of region 100*a* is the same as the color of the background region 102. When such a relative humidity reading is observed, water should be added to the sponge-like material 90 to reactivate the humidifying material. The relative humidity is too high when the color of region 100*c* is the same as the color of the background region 102. The relative humidity indicator 98 is available in the form of a humidity indicator card sold by Humidial Corporation, 926 So. 8th Street, Post Office Box 610, Colton, Calif. 92324-0610, U.S.A.

Figure 10:
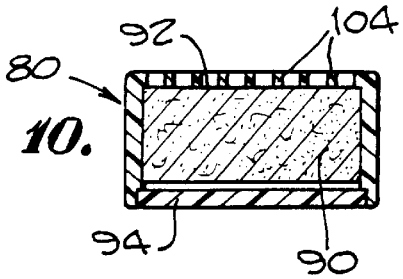
FIG. 10 is a cross-sectional side view of a humidifier enclosure of the cigar humidor taken along the plane 10—10 of FIG. 9.

The exemplary humidifier enclosure 80, as best seen in FIG. 10, includes a porous surface 92 which is provided by a plurality of interstices 104 permitting the passage of water vapor into and out of the enclosure 80.

Referring to FIG. 11, an enlarged view of the upper housing 22 and the lid 26 is shown. The cigar cutter 34 is shown in phantom lines so that the spring member 39 is seen where it makes contact with the upper housing 22 as well as the lid 26. During assembly of the cigar humidor 20, the pin 32 is inserted through the coiled portion of the spring member 39 as well as through the first and second hinge members 28, 30.

As shown in FIG. 11, the upper housing 22 and the lid 26 are preferably formed with respective indented portions 110, 112 into which the ends of the spring member 39 are fitted during assembly of the cigar humidor 20. Referring to FIG. 12, a cross-sectional side view of the cigar humidor 20 taken along the plane 12—12 of FIG. 11 is shown. As best illustrated in FIG. 13 which is an enlarged side view of the hinge mechanism at circle 13 of FIG. 12, the indented portions 110, 112 are formed sufficiently deep within the upper housing 22 and the lid 26, respectively, to prevent excessive lateral movement of the spring 39 during operation of the hinge mechanism.

And finally, the ridge 68 is best illustrated in FIG. 14 which is a cross-sectional view of the cigar humidor 20 and its attached cigar cutter 34 taken along the plane 14—14 of FIG. 11. The ridge 68 includes an inner face 114 formed on the exterior surface 66. The inner face 114 extends from the exterior surface 66 to an inwardly curved portion 116 as shown in FIG. 14. The cigar cutter 34 includes a curved side 118 formed complementary to the inner face 114 and the inwardly curved portion 116. As discussed above, the cigar cutter 34 is frictionally fit between the two ridges 68. Thus, the respective dimensions of the cigar cutter 34 and the ridges 68 as well as the relative positions of the ridges 68 on the exterior surface 66 are to be appropriately selected.

In conclusion, it is to be understood that the foregoing detailed description and the accompanying drawings illustrate the principals of the invention. However, various changes and modifications may be employed without departing from the spirit and scope of the invention. Thus, by way of example and not of limitation, materials other than those set forth with reference to the disclosed preferred embodiments may be employed. It is additionally contemplated that alternative mechanisms for securing the cigar cutter 34 to the upper housing 22 may be employed. Other mechanical changes such as the addition of a mechanism for locking the lid 26 to the upper housing 22 could also be made. Accordingly, the present invention is not limited to the specific form shown in the drawings and described in detail hereinabove.

What is claimed is:

1. A hand held portable humidor for cigars including a humidifying material for maintaining a substantially constant relative humidity within the humidor, the humidor comprising:

an upper housing including an exterior surface and an inwardly directed ridge, said upper housing being formed with an inner diameter;

a lid pivotally secured to said upper housing;

an enclosure sized to receive the humidifying material, said enclosure including at least one porous surface and a tab portion positioned against said lid to retain said enclosure within said lid and to provide a means for removing said enclosure from said lid;

a lower housing formed of a material less rigid than said upper housing, said lower housing being formed with an outer diameter, said lower housing being telescopically fitted within said upper housing, said outer diameter being greater than said inner diameter and the material being sufficiently lubricative such that a sliding, substantially hermetic seal is maintained between said upper housing and said lower housing, said lower housing including an interior surface defining slots for receiving at least one partition, said lower housing including an outwardly directed ridge which contacts the inwardly directed ridge of said upper housing when the humidor is a fully extended configuration preventing said lower housing from separating from said upper housing;

a cigar cutter; and means formed on the exterior surface for detachably securing said cigar cutter to the upper housing.

2. A hand held portable humidor including a humidifying material for maintaining a substantially constant relative humidity within the humidor, the humidor comprising:

an upper housing including a lid sized to receive the humidifying material; and a lower housing formed of a material less rigid than said upper housing, said lower housing being telescopically fitted within said upper housing said lower housing being sized sufficiently large relative to said upper housing and the material being sufficiently lubricative such that a sliding, substantially hermetic seal is maintained between said upper housing and said lower housing.

3. The hand held portable humidor of claim 2 wherein:

said upper housing has an inner diameter; and said lower housing has an outer diameter which is greater than the inner diameter of said upper housing.

4. The hand held portable humidor of claim 2 wherein:

said upper housing includes an inwardly directed ridge; and said lower housing includes an outwardly directed ridge which contacts the inwardly directed ridge of said upper housing when the humidor is in a fully extended configuration thereby preventing said lower housing from separating from said upper housing.

5. The hand held portable humidor of claim 2 comprising:

hinge means for pivotally securing the lid to said upper housing.

6. The hand held portable humidor of claim 2 further comprising:

at least one partition fitted within said housing.

7. The hand held portable humidor of claim 2 further comprising:

an enclosure sized to receive the humidifying material, said enclosure including at least one porous surface.

8. The hand held portable humidor of claim 7 further comprising:

a plurality of fins formed within said lid securing said enclosure within said lid.

9. The hand held portable humidor of claim 7 wherein said enclosure further comprises:

a tab portion positioned against said lid to retain said enclosure within said lid and to provide a means for removing said enclosure from said lid.

10. The hand held portable humidor of claim 2 further comprising:

an indicator providing an indication of a relative humidity within the humidor.

11. A hand held portable humidor for cigars including a humidifying material for maintaining a substantially constant relative humidity within the humidor, the humidor comprising:

a housing including an exterior surface;

a lid pivotally secured to said housing and sized to receive the humidifying material;

a cigar cutter; and means formed on the exterior surface for detachably securing said cigar cutter to the housing.

12. The hand held portable humidor of claim 11 wherein:

said securing means comprises a plurality of ridges formed on the exterior surface.

13. The hand held portable humidor of claim 12 where:

said cigar cutter includes a surface complementary to a surface of said plurality of ridges for detachably securing said cigar cutter to said housing.

14. The hand held portable humidor of claim 11 further comprising:

hinge means for pivotally securing said lid to said housing.

15. The hand held portable humidor of claim 14 wherein:

said securing means comprises a plurality of ridges formed on the exterior surface, at least one of the ridges being positioned to support said hinge means.

16. The hand held portable humidor of claim 11 further comprising:

at least one partition fitted within said housing.

17. The hand held portable humidor of claim 11 further comprising:

an enclosure sized to receive the humidifying material, said enclosure including at least one porous surface.

18. The hand held portable humidor of claim 17 further comprising:

a plurality of fins formed within said lid securing said enclosure within said lid.

19. The hand held portable humidor of claim 17 wherein said enclosure further comprises:

a tab portion positioned against said lid to retain said enclosure within said lid and to provide a means for removing said enclosure from said lid.

20. The hand held portable humidor of claim 11 further comprising:

an indicator providing an indication of a relative humidity within the humidor.

* * * * *